US005956815A

United States Patent [19]

O'Connor et al.

[11] Patent Number: 5,956,815

[45] Date of Patent: Sep. 28, 1999

[54] SLIDER ZIPPER RECLOSEABLE FASTENER

[75] Inventors: Thomas P. O'Connor, Shelbyville, Ind.; James W. Burke, Cleves, Ohio

[73] Assignee: KCL Corporation, Shelbyville, Ind.

[21] Appl. No.: 08/859,806

[22] Filed: May 19, 1997

[51] Int. Cl.[6] ..... A44B 19/16

[52] U.S. Cl. ..... 24/30.5 R; 24/400

[58] Field of Search ..... 24/30.5 R, 427, 24/399, 400, 587; 383/64, 69

[56] References Cited

U.S. PATENT DOCUMENTS

| | | | |
|---|---|---|---|
| 2,994,469 | 8/1961 | Troup et al. . | |
| 3,122,807 | 3/1964 | Ausnit . | |
| 3,173,184 | 3/1965 | Ausnit . | |
| 3,713,923 | 1/1973 | Laguerre | 24/427 X |
| 4,212,337 | 7/1980 | Kamp | 24/399 X |
| 5,007,142 | 4/1991 | Herrington . | |
| 5,007,143 | 4/1991 | Herrington . | |
| 5,010,627 | 4/1991 | Herrington et al. . | |
| 5,020,194 | 6/1991 | Herrington et al. . | |
| 5,063,644 | 11/1991 | Herrington et al. . | |
| 5,067,208 | 11/1991 | Herrington Jr. et al. . | |
| 5,131,121 | 7/1992 | Herrington, Jr. et al. . | |
| 5,211,482 | 5/1993 | Tilman . | |
| 5,283,932 | 2/1994 | Richardson et al. . | |
| 5,293,671 | 3/1994 | Oda . | |
| 5,301,394 | 4/1994 | Richardson et al. . | |
| 5,442,837 | 8/1995 | Morgan . | |
| 5,442,838 | 8/1995 | Richardson et al. . | |
| 5,482,375 | 1/1996 | Richardson et al. . | |
| 5,664,299 | 9/1997 | Porchia et al. | 24/400 |

FOREIGN PATENT DOCUMENTS

| | | | |
|---|---|---|---|
| 1564039 | 4/1969 | France | 24/400 |

*Primary Examiner*—James R. Brittain

*Attorney, Agent, or Firm*—Woodard, Emhardt, Naughton Moriarty & McNett Patent and Trademark Attorneys

[57] ABSTRACT

A slider zipper reclosable fastener wherein the zipper includes fastener strips and closure elements on the fastener strips which are extruede integrally. The closure elements are arranged at particulare angles by extrusion opeining angles in order to increase burst strength. Ridges on the fastener strips and shoulders on the slider hold the slider on the zipper.

8 Claims, 8 Drawing Sheets

SLIDER ZIPPER RECLOSEABLE FASTENER

FIELD OF THE INVENTION

The present invention relates to reclosable plastic bags with slider zippers.

DESCRIPTION OF THE PRIOR ART

One type of plastic zipper includes profiles which have a pair of male and female fastener rib and groove elements with a slider for opening or closing the rib and groove elements. In the manufacture of plastic film bags, a pair of these male and female fastener elements extend along the mouth of the bag and are secured to the bag. These elements may be integral marginal portions of the bag walls or they may be extruded separately and thereafter attached to the wall along the mouth of the bag.

The sliders for opening and closing the reclosable fasteners may be essentially U-shaped and may be adapted to be assembled with the fastener by a relative transverse maneuver. The slider is molded from a semi-hard plastic where there is enough yieldability in the side walls of the slider to provide sufficient flexibility to enable spreading apart of the terminal portions of the side walls of the slider so as to clear the interlocking rib and groove elements to permit assembly of the slider with the zipper by relative transverse movement.

One of the problems involved in the design of a slider zipper is providing workable means for retaining the slider on zipper.

Another problem involved in the design of a slider zipper is the burst strength or inside force of the zipper. It is desirable that the zipper be able to remain closed even though the force or pressure acting from inside the bag is substantial, such as, as high as in the range of approximately 35 to 40 psig. Such high burst strength insures that the bag will remain closed even though the contents of the bag are forced against the fastener elements tending to open the bag.

SUMMARY OF THE INVENTION

One embodiment of the invention might involve a reclosable fastener assembly including a first fastener strip having an inner surface and an outer surface. There is also provided a second fastener strip having an inner surface and an outer surface. A first profile is positioned along the length of the inner surface of the first fastener strip. The first profile has a plurality of closure elements, the plurality of closure elements including at least an uppermost element and a bottommost element.

There is also provided a second profile positioned along the length of the inner surface of the second fastener strip. The second profile has a plurality of closure elements, the elements including at least an uppermost element and a bottommost element. The elements of the second profile are adapted to engage with the elements of the first profile thereby interlocking the second profile with the first profile.

A slider for moving between a closed position and an open position is also provided. The slider moves from the closed position to the open position and back along the fastening strips in straddling relation. The slider has a top and side walls depending from opposite sides of the top for receiving the fastening strips therebetween. The side walls extend downward from the top to a point at or below the profiles so that at least a portion of the profiles are held between the side walls. The side walls extend from a separating end of the slider to a pinching end.

The side walls have a greater spacing at the separating end than at the pinching end and are spaced close enough at the pinching end to press the first and second profiles into an interlocked relationship as the slider is moved toward the closed position. The slider also has a separating leg depending from the top between the first and second side walls at the separating end of the slider. The separating leg is inserted between at least the uppermost closure elements of the first and second profiles.

There is also provided means for maintaining the slider in straddling relation with the fastener strips including shoulders depending from the side walls of the slider. There is further provided ridges projecting from the outside edges of the fastener strips along the lengths thereof at or below the profiles so that the shoulders grasp the surfaces of the ridges.

Another embodiment of the invention might include a reclosable fastener assembly including a first fastener strip having an inner surface and an outer surface. A second fastener strip is also provided having an inner surface and an outer surface. A first profile is positioned along the length of the inner surface of the first fastener strip. The first profile has a plurality of closure elements. The plurality of closure elements include at least an uppermost element and a bottommost element.

There is also provided a second profile positioned along the length of the inner surface of the second fastener strip. The second profile has a plurality of closure elements, the elements including at least an uppermost element and a bottommost element. The elements of the second profile are adapted to engage with the elements of the first profile thereby interlocking the second profile with the first profile.

There is also provided a slider for moving between the closed position and an open position along the fastening strips in straddling relation. The slider has a top and side walls depending from opposite sides of the top for receiving the fastening strips therebetween. The side walls extend downward from the top to a point at or below the profiles so that at least a portion of the profiles are held between the side walls. The side walls extend from a separating end of the slider to a pinching end. The side walls have a greater spacing at the separating end than at the pinching end. The side walls are spaced close enough at the pinching end to press the first and second profiles into an interlocked relationship as the slider is moved toward the closed position. Also the slider has a separating leg depending from the top between the first and second side walls at the separating end of the slider. The separating leg is inserted between at least the uppermost closure elements of the first and second profiles.

The first fastener strip and first profile is formed as an integral extruded first product wherein the first profile uppermost element and bottommost element are shaped as hooks with a first proximal portion and a first distal portion. The second fastener strip and second profile is formed as an integral extruded second product wherein said second profile uppermost element and bottommost element are shaped as hooks with a second proximal portion and a second distal portion.

The first extruded product is formed by a first extrusion die with an extrusion opening defining an angle between the first fastener strip and a first bottommost proximal portion at approximately 105°. The second extruded product is formed by a second extrusion die with an extrusion opening defining an angle between the second fastener strip and the second bottommost proximal portion at approximately 85°.

DESCRIPTION OF THE PREFERRED EMBODIMENT

Figure 1:
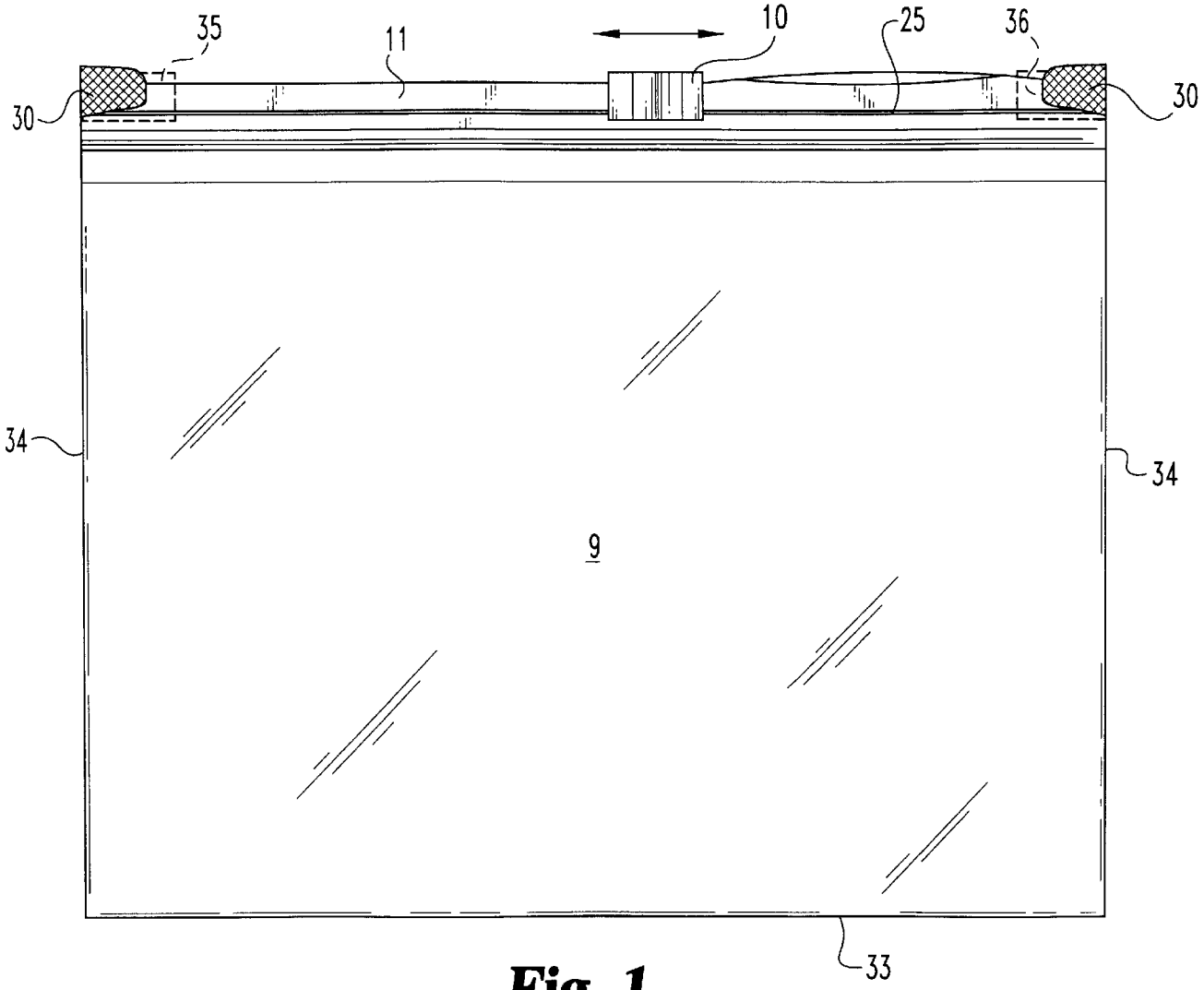
FIG. 1 is a plan view of a plastic bag having a zipper and a slider.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is shown a reclosable thermoplastic bag 9 having a profiled plastic reclosable fastener 11 and a slider 10, embodying the present invention. Bag 9 also has a sealed bottom 33 and two opposing sealed edges 34. Bag 9 may be made from any suitable thermoplastic film such as, for example, low density polyethylene, linear low density polyethylene, substantially linear copolymers of ethylene and a C3–C8 α-olefin, polypropylene, polyvinylidene chloride styrene butadene, mixtures of two or more of these polymers, or mixtures of one of these polymers with another thermoplastic polymer.

Figure 2:
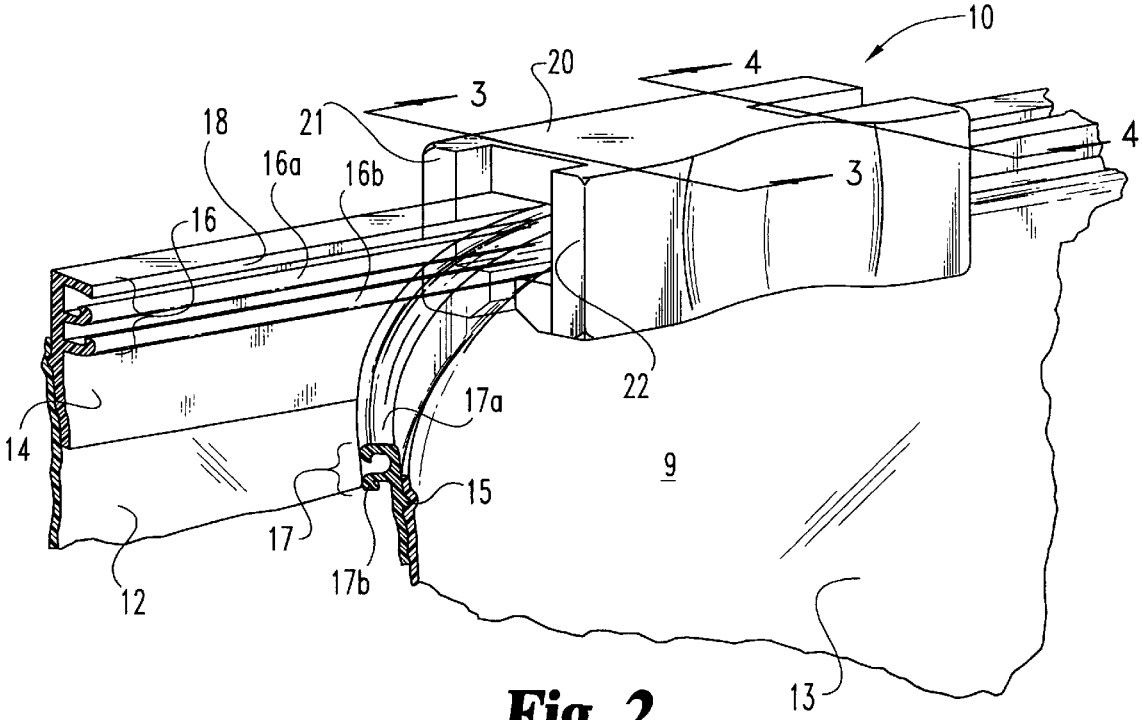
FIG. 2 is a perspective view of a reclosable plastic bag with zipper and slider.
Figure 3:
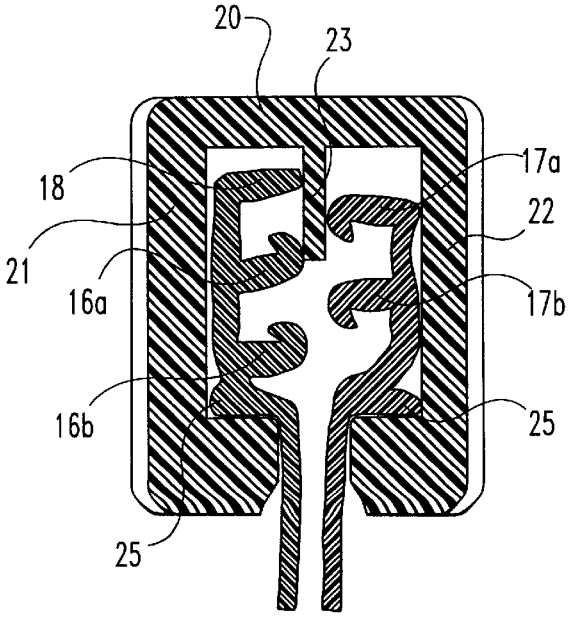
FIG. 3 is a cross sectional view of an open profile and slider of the instant invention taken along line 3—3 of FIG. 2.

Referring now to FIG. 2, the bag 9 comprises a pair of flexible plastic sheets 12 and 13. The sheet 12 has a top edge having a first fastener strip 14 attached thereto. The first fastener strip 14 has an inner surface on the inside of the bag and an outer surface on the outside of the bag. The sheet 13 has a top edge having a second fastener strip 15 attached thereto. The second fastener strip 15 has an inner surface on the inside of the bag and an outer surface on the outside of the bag. The strips 14 and 15 may be extruded separately and attached to the respective sides of the bag mouth or the strips 14 and 15 may be extruded integrally with the sides of the bag mouth.

A first profile 16 extends along the inner surface of the first fastener strip 14. A second profile 17 extends along the inner surface of the second fastener strip 15.

As shown in FIGS. 2–5, the first profile 16 has at least an uppermost closure element 16*a* and a bottommost closure element 16*b*. The closure elements 16*a* and 16*b* project laterally from the inner surface of strip 14. Likewise, the second profile 17 has at least an uppermost closure element 17*a* and a bottommost closure element 17*b*. The closure elements 17*a* and 17*b* project laterally from the inner surface of strip 15. When the bag is closed, the closure elements of profile 16 interlock with the corresponding closure elements of profile 17. As shown in FIGS. 2–5, closure elements 16*a*, 16*b*, 17*a* and 17*b* have hooks on the ends of the closure elements, so that the profiles remain interlocked when the bag is closed, thereby forming a seal. The seal advantageously is such that under normal conditions of use, it forms a barrier to liquids. Profiles 16 and 17 can each have more than two closure elements, so that any number of closure elements can be disposed between the uppermost and bottommost closure elements.

Figure 4:
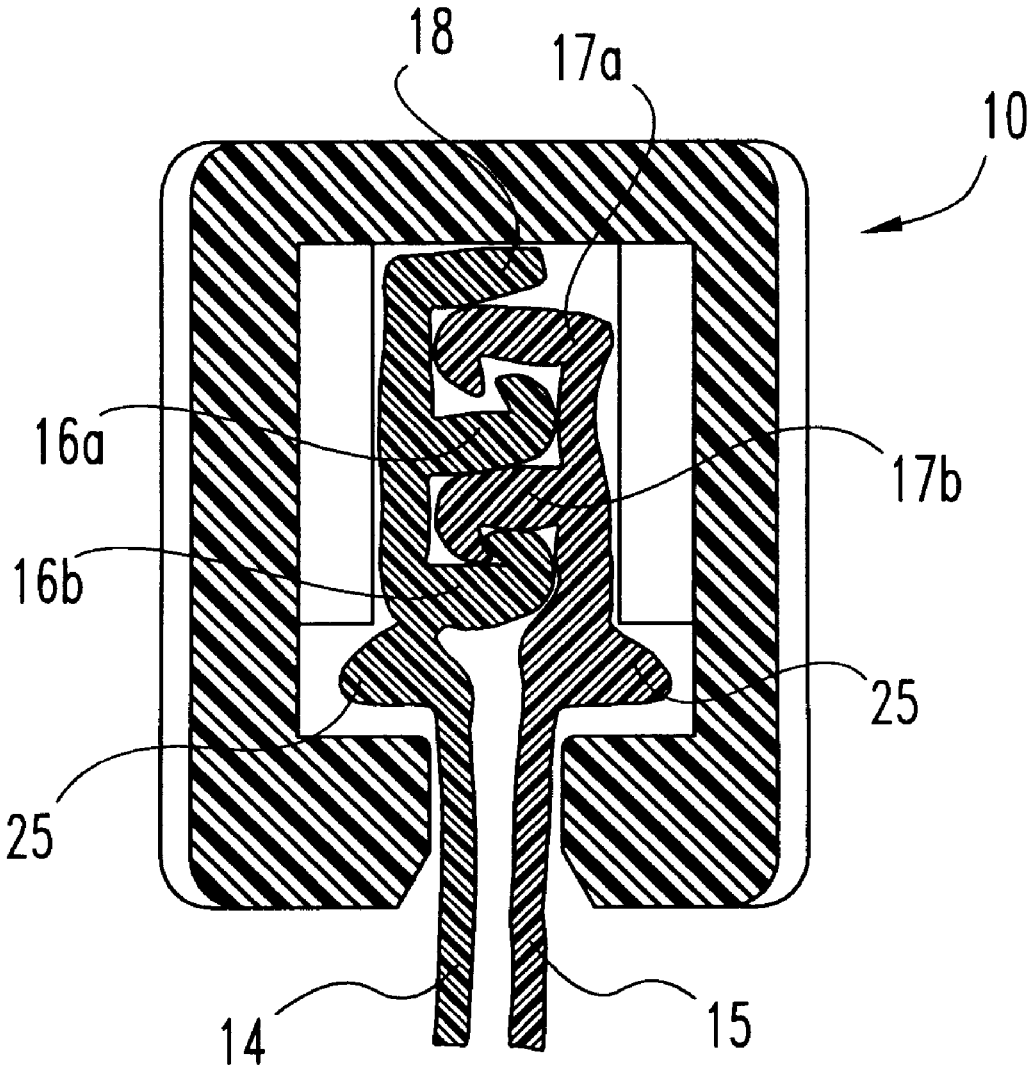
FIG. 4 is a cross sectional view of a closed profile and slider of the instant invention taken along line 4—4 of FIG. 2.

When the bag 9 is open, fastener strips 14 and 15 are separated from each other as are the profiles 16 and 17 on the respective strips. As shown in FIG. 4, closure elements 16*a*, 17*a*, 16*b*, and 17*b* have a complementary cross-sectional shape such that they are closed by pressing the profiles together. The pressing action is accomplished by pinching end 10*b* of the slider 10 which straddles the fastener strips 14 and 15 and is adapted to close or open the elements 16 and 17 of the reclosable fastener.

Referring again to FIG. 1, the slider 10 moves between a closed position 35 and an open position 36. Thus, when the slider 10 reaches the closed position 35 at one end of the fastening strips, the bag is closed, and the profiles are interlocked throughout substantially their entire length. When the slider reaches the open position 36 at the opposite end of the fastening strips, the bag is open and the profiles are disengaged throughout most of their length. It should be understood that it is sufficient for at least the bottommost closure elements to be interlocked with each other through substantially their entire length, in order for the bag to be closed. Preferably, the uppermost closure elements are also interlocked with each other, although they need not be.

Referring now to FIG. 2, the straddling slider 10 comprises an inverted U-shaped member having a top 20 for moving along the top edges of the strips 14 and 15. The slider 10 has side walls 21 and 22 depending from the top 20. Side walls 21 and 22 extend downward along the outer surface of the fastener strips 14 and 15, to a point at or below the profiles 16 and 17, so that at least a portion of the profiles 16 and 17 are held between the side walls 21 and 22. Side walls 21 and 22 cooperate with the strips 14 and 15 so that, as the slider moves between the open and closed position, strips 14 and 15 are received between the side walls 21 and 22.

Figure 5:
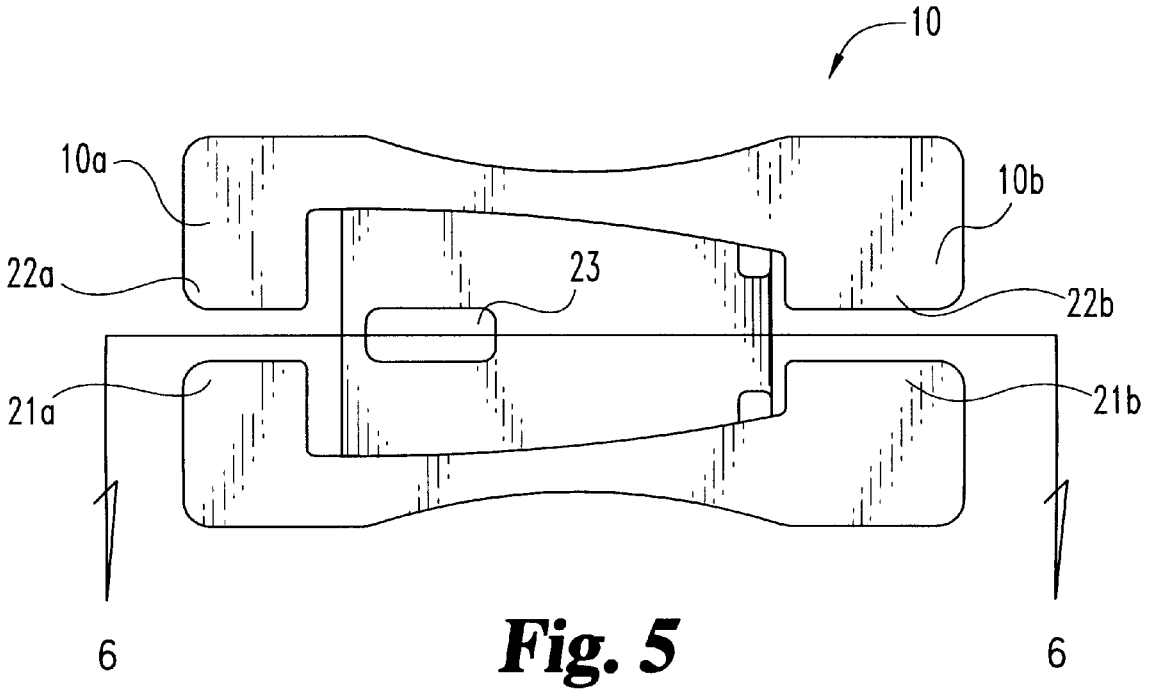
FIG. 5 is a bottom plan view of the slider in FIG. 2.
Figure 6:
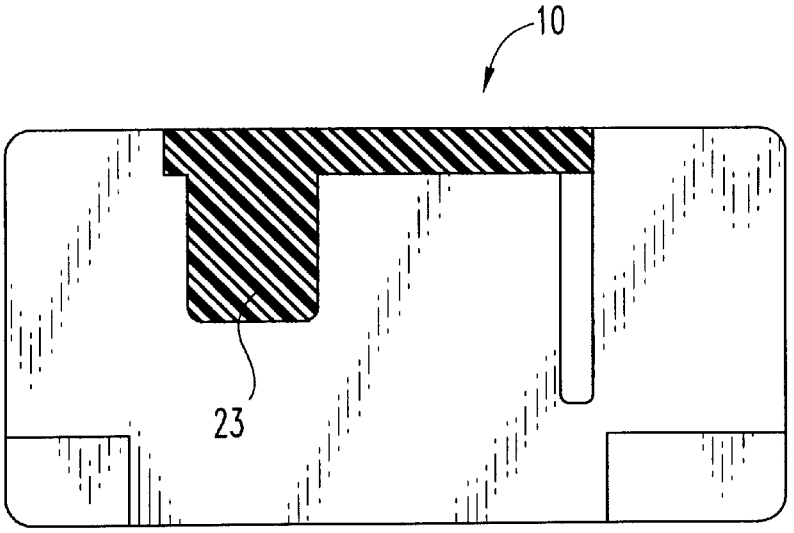
FIG. 6 is a cross sectional view of a slider taken along line 6—6 of FIG. 5.

As shown in FIG. 5, side walls 21 and 22 extend from a separating end 10*a* of the slider to a pinching end 10*b* of the slider. The side walls 21 and 22 are spaced farther apart at the separating end 10*a* than at the pinching end 10*b*. The closer spacing at the pinching end 10*b* acts to pinch, or squeeze the fastening strips together, thereby forcing the profiles 16 and 17 into an interlocked relationship. As shown in FIG. 4, the profiles are preferably squeezed together all at once, i.e., the uppermost closure elements 16*a* and 17*a* are pressed together at approximately the same time that the bottommost closure elements 16*b* and 17*b* are pressed together.

As shown in FIGS. 2–7, a separating leg 23 depends from the top 20 between the side walls 21 and 22 and is inserted between the uppermost closure elements 16*a* and 17*a* of profiles 16 and 17. Preferably, the separating leg is positioned at the separating end 10*a* of the slider 10. Preferably, the separating leg 23 has a width, i.e., a dimension from side to side, of from about 1/32 to about 1/8 inches. Preferably, the separating leg has a length, i.e., a dimension from the separating end to the pinching end, of from about 1/16 to about 1/4 inches. Preferably the separating leg has a height or projecting dimension from the top 20 of from about 1/32 to about 1/8 inches.

The profile 16 also preferably includes a flange 18 which has a straight flat configuration and functions to overlie the uppermost closure element 17*a* of the profile 17 so as to give the bag and fastener assembly an aesthetically pleasing closed appearance when the slider is moved to the closed position 35. The separating leg 23 does not extend all the way through the profiles 16 and 17. Preferably, the separating leg extenbs between the flange 18 and the closure element 17*a* but does not extend far enough to reach between the bottommost closure elements 16*b* and 17*b*. Alternatively, the separating leg 23 may extend through the uppermost closure elements 16*a* and 17*a* but does not extend far enough to reach between the bottommost closure elements of 16*b* and 17*b*. If the profile has intermediate closure elements between the uppermost and bottommost closure elements, the separating leg can extend between the intermediate closure elements, although the separating leg need not do so.

When the slider 10 is moved toward the open position 36, the pinching end 10*b* of the slider leads, and the separating end 10*a* of the slider trails, so that the separating leg 23 disengages the profiles 16 and 17. When the slider 10 is moved toward the closed position 35, the separating end 10*a* leads and the pinching end 10*b* trails, so that the pinching end 10*b* squeezes the profiles together into engagement. The spacing between the bottommost closure elements 16*b* and 17*b* and the uppermost closure elements 16*a* and 17*a*, should be sufficient so that the bottommost profiles are pulled open as the separating leg 23 forces the uppermost closure elements apart when the slider moves toward the open position 36.

The fastening assembly includes means for maintaining the slider in straddling relation with the fastening strips. In the embodiment shown in FIGS. 2–7, the means includes ridges 25 on the outer surfaces of the fastening strips 14 and 15, the shoulders 21*a*, 22*a*, 21*b* and 22*b* on the side walls of the slider. Shoulders 21*a* and 22*a* project inwardly from the depending side walls at the separating end 10*a* of the slider. As shown, the slider also has shoulders 21*b* and 22*b* projecting inwardly from the depending side walls at the pinching end 10*b* of the slider. The shoulders 21*a*, 22*a*, 21*b* and 22*b* project inwardly at a point at or below the profiles 16 and 17. The shoulders act as means for maintaining the slider in straddling relation with the fastening strips by grasping the lower surfaces of the ridges 25. The ridges 25 thus act as handles for the slider to hold onto, such that the slider 10 maintains the straddling relation with the fastening strips and does not fall off the bag. The shoulders can be continuous along the entire length of the slider, if desired, in order to maximize the security to the bag. Ridges 25 extend along the length of the outer surface of fastener strips 14 and 15 at a point at or below the profiles, and can be attached to the fastener strips by any desired means, such as, for example, by extruding with the fastener strips, heating, gluing, or snapping in place. The ridges can also result from the difference in thicknesses between the profiles and the bag.

The slider 10 may be made in multiple parts and welded together or the parts may be constructed to be snapped together. The slider 10 may also be of one piece construction. The slider can be made using any desired method, such as, for example, injection molding or any other method. The slider can be molded from any suitable plastic such, for example, as nylon, polypropylene, polystyrene, acetal, toughened acetal, polyketone, polybutylene terephthalate, high density polyethylene, polycarbonate, or ABS. The slider can be clear, opaque, or colored.

A bag incorporating the fastener and slider of the present invention desirably includes means for preventing the slider from sliding off the end of the bag once the slider reaches the closed position 35 or open position 36. Preferably, the means for preventing the slider from sliding off the end includes means for holding the bottommost closure elements in interlocked relationship when the slider is in the closed position, including the area beneath the separating leg, such that the bottommost closure elements are in interlocked relationship throughout substantially their entire length. Such means for holding the bottommost closure elements together can include, for example, a fused section of the bottommost closure elements proximate to the closed position 35. The fused section of the profiles proximate to the closed position preferably creates a raised end stop 30. Preferably, a fused section of the profiles is also proximate to the open position 26.

"Proximate to the closed position" is defined herein to mean, when the slider is in the closed position, the space at least between the slider and the ends of the fastener strips. This distance can be narrow, if the closed position is chosen to be towards the very end of the fastener strip, or this distance can be wide, if the closed position is chosen to be farther away from the ends of the fastener strips, such as when large end stops are desired.

When a fused end stop 30 is used in conjunction with a ridge 25, it is preferred that the ridge 25 extends on each end at least to an inward edge 31 of the fused section, and preferably past the inward edge thereof, as shown in FIG. 1, so that the ridge 25 works to cooperate with the fused section 30 to hold the slider 10 onto the bag.

The profiles can be fused by a clamp, an adhesive, pressure, heat, mechanically, ultrasonically, or by any other desired method. The resulting end stops 30 perform the dual function of stops for the ends of the fastener 11 to prevent the slider 10 from going off past the end of the fastener 11 and they also hold the two profiles 16 and 17 together to prevent the bag from opening in response to stresses applied to the profiles through normal use of the bag. The end stops 30 also provide a convenient finger grip for the user when moving the slider 10.

Alternative means for preventing the slider from sliding off the end of the bag include riveted end clamps such as those described in U.S. Pat. Nos. 5,067,208 and 5,161,286, transverse end stops made from molten material for the profiles, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807.

The fastening assembly of the present invention optionally includes means for retaining the slider in the closed position so that a bag incorporating the zipper and slider of the present invention does not inadvertently open. For example, the means for retaining the slider in closed position can comprise a notch structure such as that disclosed in U.S. Pat. No. 5,067,208, or a notch structure with diverging ends such as that disclosed in U.S. Pat. No. 5,301,395. In yet another alternative, the means for retaining the slider in closed position can comprise a latching means, such as a detent on the slider together with a protrusion on the zipper as disclosed in U.S. Pat. No. 5,189,764.

The bag of the present invention can be made using methods well known in the art, such as, for example, by mono or multilayer blow or cast extrusion. The slider can be attached to the fastener strips using methods such as causing reciprocal movements of the clasp using a tool, as described in U.S. Pat. No. 4,262,395, through a hinge structure which attaches wings to the body of the slider, as described in U.S. Pat. No. 5,067,208, through a rigidizing structure as described in U.S. Pat. No. 5,283,932, or though in-place assembly.

Figure 7:
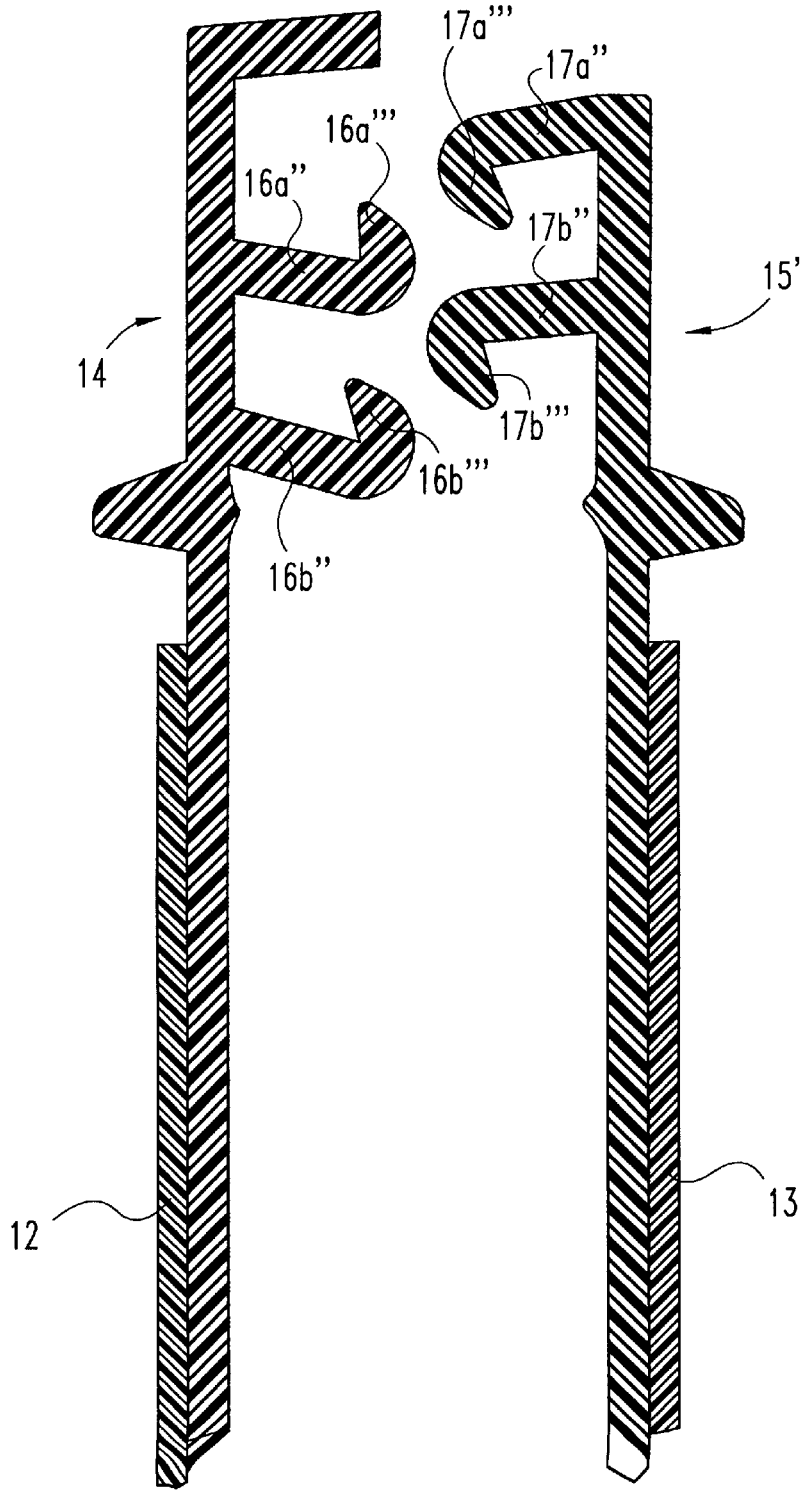
FIG. 7 is a cross sectional view of the zipper of the present invention showing it in open condition.
Figure 9:
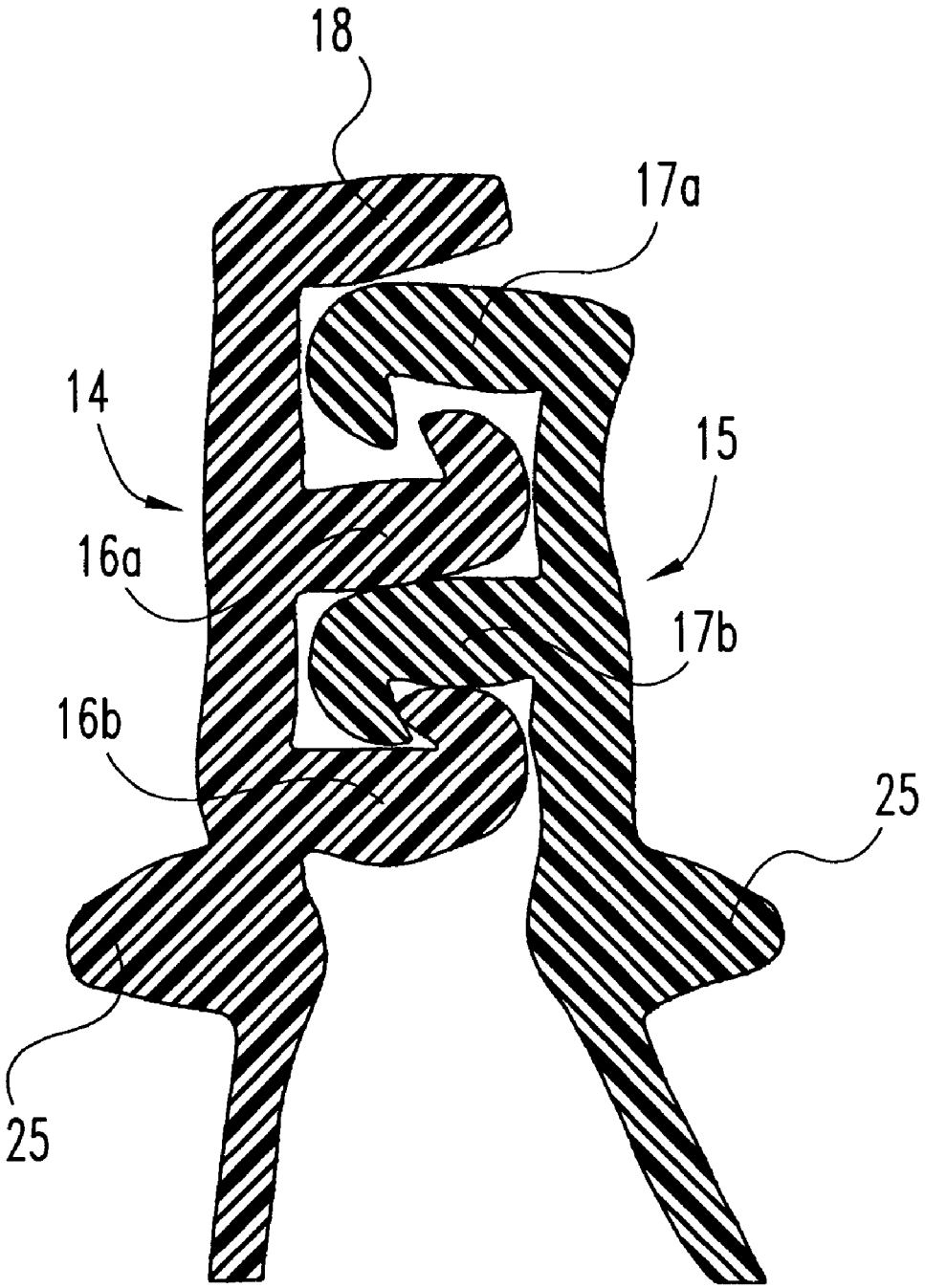
FIG. 9 is a shadow mask view showing the actual cross sectional configuration of the closed zipper of the present invention.
Figure 10A:
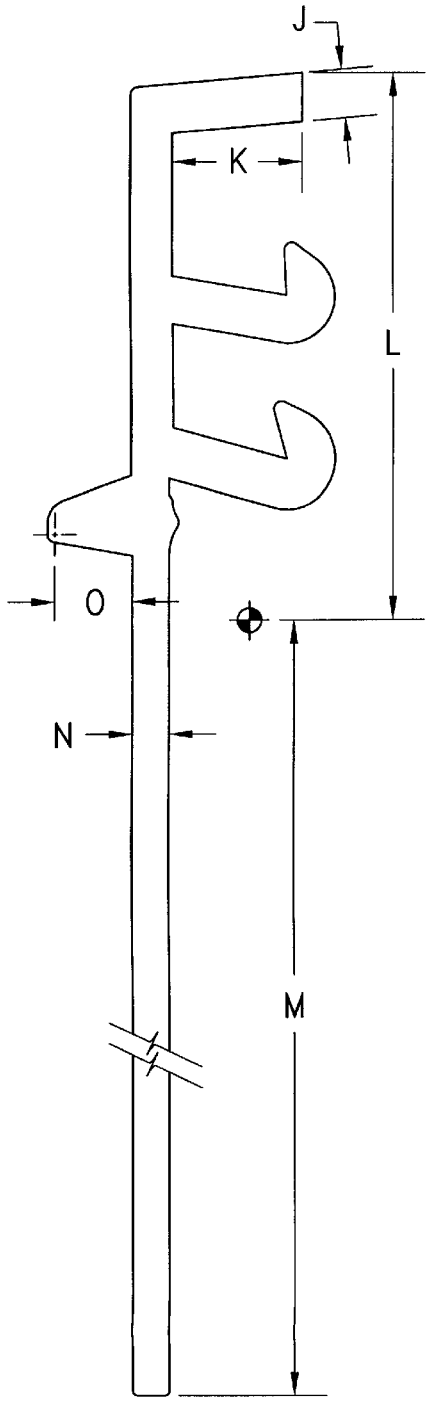
FIG. 10*a* and 10*b* are elevational views showing the dimensions and angles of the extrusion openings of representative extrusion dies used for the present invention.
Figure 10B:
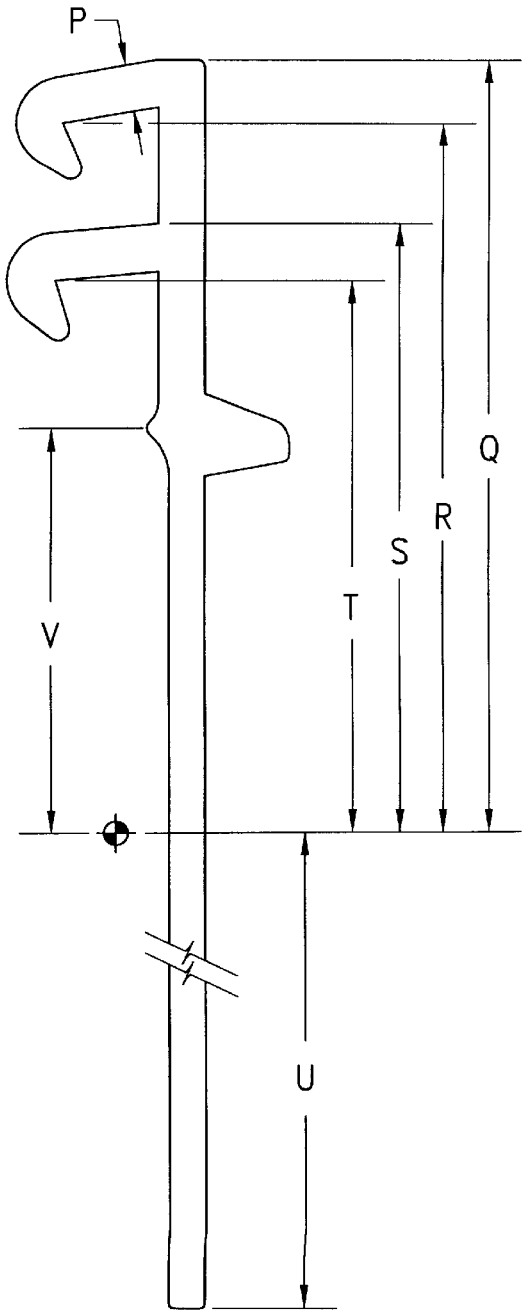

Referring now to FIG. 7 there is illustrated the pair of fastener strips 14 and 15 with integral profiles 16 and 17 thereon as they might appear if they maintained the same cross sectional configuration as that of the extrusion openings in the dies from which they are extruded. Instead the fastener strips and profiles more correctly have the configuration illustrated in FIG. 9 which is a reproduction of a "shadow mask" of the fastener strips and profiles.

Figure 8A:
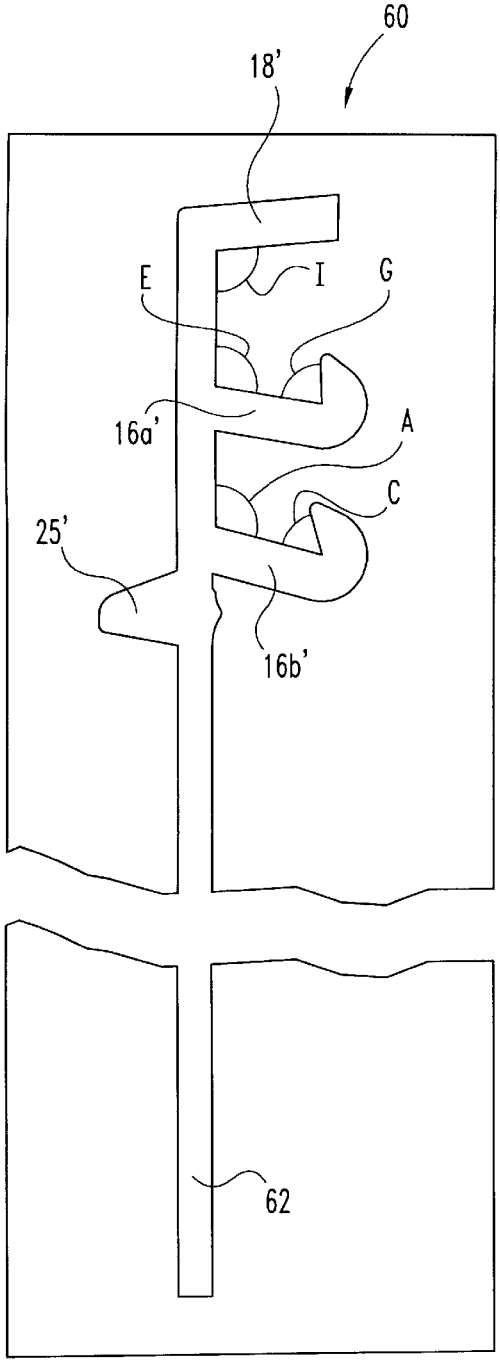
FIG. 8*a* and 8*b* are elevational views of extrusion dies for forming the profiles of the zipper of the present invention.
Figure 8B:
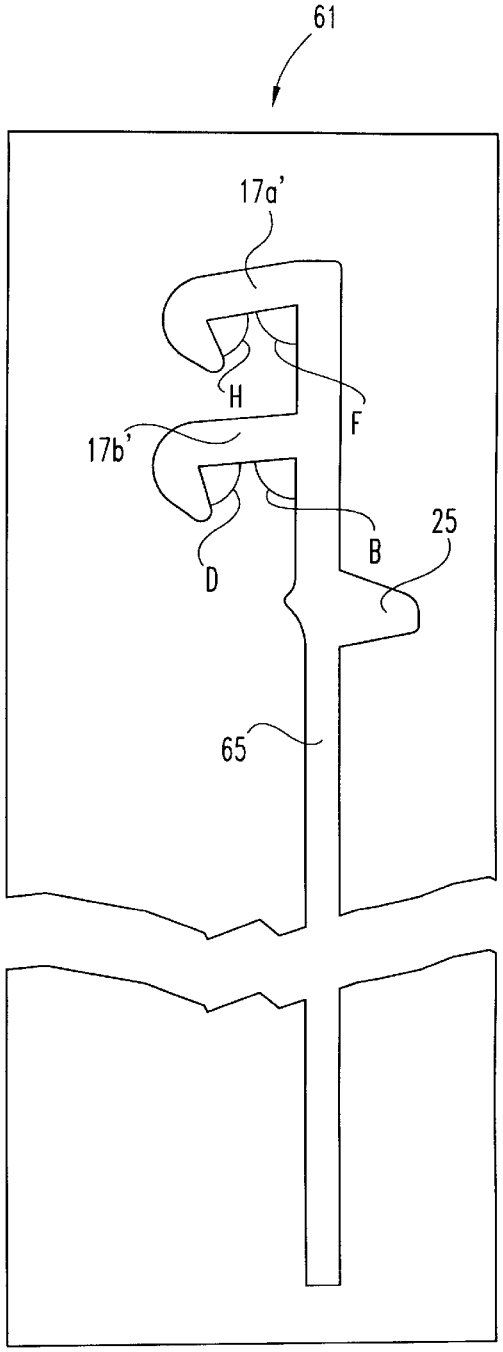

FIGS. 8*a* and 8*b* are elevational views of extrusion dies 60 and 61 which have extrusion openings 62 and 65 which are adapted to extrude the fastener strips 14 and 15, respectively. The extrusion process for forming the fastener strips is carried out in a conventional manner well known to those of ordinary skill in the art. It is sufficient to state that the extrusion process to make the fastener strips and integral profiles is carried out with a vertical extruder that extrudes the strips and profiles vertically downwardly into a water bath.

One of the problems that the present invention solves is low burst strength. One manner of solving this problem might involve the use of the closure strip 13 of the Ausnit U.S. Pat. No. 3,122,807 wherein there is a recess between the web portion 17 and the marginal portion 18. Such a construction is difficult to manufacture however. The use of angles was found to solve the problem and to still maintain relative ease of manufacture. Thus the extrusion opening 62 has a portion 25' that forms the ridge 25 on the fastener strip 14. Further, the extrusion opening 62 has portions 18', 16*a*' and 16*b*' that form the flange 18, the uppermost closure element 16*a* and the bottommost closure element 16*b*, respectively. Similarly tile extrusion opening 65 has portions 17*a*', 17*b*' and 25 that form the uppermost closure element 17*a*, the bottommost closure element 17*b* and the ridge 25, respectively, on the fastener strip 15. Also each of the closure elements 16*a*, 16*b*, 17*a* and 17*b* has a hook shape with a proximal portion 16*a*", 16*b*", 17*a*" and 17*b*", respectively (See FIG. 7) and also a distal portion 16*a*'", 16*b*'", 17*a*'" and 17*b*'", respectively.

It was found that the burst strength of the structure was increased from approximately 24 psig. to a range of approximately 35 to approximately 40 psig. by setting the angles of the extrusion opening of the fastener strips and the bottommost proximal portions at approximately 105° and 85°, respectively. More particularly the angle A in FIG. 8*a* was determined to be approximately 105° and the angle B in FIG. 8*b* was determined to be approximately 85°. These angles produced integral profiles and fastener strips which do not leak and have high burst strength.

In a preferred embodiment of the invention the extrusion die extrusion opening 62 defined an angle C between the proximal portion and distal portion of the bottommost closure element opening 16*b* of approximately 57°. Also in that preferred embodiment the extrusion die extrusion opening 65 defined in an angle D between the proximal portion and distal portion of the bottommost closure element opening 17*b*' of approximately 73°.

In designing the extrusion die extrusion openings to properly produce the uppermost closure elements attention was given to determining the angles of the uppermost closure elements as regards the proximal and distal portions of the hook shapes as well as the angles between the proximal portions and the fastener strips. Thus the angle E of the extrusion opening 62 was determined to be best at approximately 100° because with this angle the closure element 17*b* was best held in place in the closed bag condition, that is, with the slider at the closed position 35. Also the angle F was determined to be approximately 80°, angle G approximately 78° and the angle H approximately 73°.

In one embodiment of the invention the flange 18 was extruded from the extrusion opening 62 with the angle I at 90°. This arrangement produces a workable profile for the fastener strip 14. However, in such an embodiment there was found in some cases difficulty in opening the zipper. Therefore a preferred embodiment of the invention includes an extrusion opening 62 having an angle I of approximately 95°.

Further dimensions of a preferred embodiment of extrusion openings of the extrusion dies of the invention are set forth below:

| | |
|---|---|
| J - .052 inches | Q - .874 inches |
| K - .139 inches | R - .801 inches |
| L - .625 inches | S - .889 inches |
| M - 1.377 inches | T - .627 inches |
| N - .039 inches | U - 1.250 inches |
| O - .082 inches | V - .471 inches |
| P - .052 inches | |

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A reclosable fastener assembly comprising:

a first fastener strip having an inner surface and an outer surface;

a second fastener strip having an inner surface and an outer surface;

a first profile positioned along the length of the inner surface of the first fastener strip, the first profile having a plurality of closure elements, the plurality of closure elements including at least an uppermost element and a bottommost element;

a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile; and a slider for moving between a closed position and an open position along the fastening strips in straddling relation, the slider having a top and side walls depending from opposite sides of the top for receiving the fastening strips therebetween, the side walls extending downward from the top to a point at or below the profiles, so that at least a portion of the profiles are held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles;

said first fastener strip and first profile being formed as an integral extruded first product wherein said first profile uppermost element and bottommost element are shaped as hooks with a first proximal portion and a first distal portion;

said second fastener strip and second profile being formed as an integral extruded second product wherein said second profile uppermost element and bottommost element are shaped as hooks with a second proximal portion and a second distal portion;

said first extruded product being formed by a first extrusion die with an extrusion opening defining an angle between the first fastener strip and a first bottommost proximal portion at approximately 105° and, said second extruded product being formed by a second extrusion die with an extrusion opening defining an angle between the second fastener strip and second bottommost proximal portion at approximately 85°.

2. The reclosable fastener assembly of claim 1 wherein said first extrusion die extrusion opening defines an angle between the first proximal portion and first distal portion of the bottommost element at approximately 57° and said second extrusion die extrusion opening defines an angle between the second proximal portion and second distal portion of the bottommost element at approximately 73°.

3. The reclosable fastener assembly of claim 2 wherein said first extrusion die extrusion opening defines an angle between the first proximal portion and first distal portion of the uppermost element at approximately 78° and said second extrusion die extrusion opening defines an angle between the second proximal portion and second distal portion of the uppermost element at approximately 73°.

4. The reclosable fastener assembly of claim 3 wherein said first profile includes a flange located upwardly and outboard of said first uppermost element, said flange being adapted to cover said second uppermost element when said profiles are in interlocked relationship.

5. The reclosable fastener assembly of claim 4 wherein said first extrusion die extrusion opening defines an angle between the first fastener strip and the flange of approximately 95°.

6. A reclosable fastener assembly comprising:

a first fastener strip having an inner surface and an outer surface;

a second fastener strip having an inner surface and an outer surface;

a first profile positioned along the length of the inner surface of the first fastener strip, the first profile having a plurality of closure elements, the plurality of closure elements including at least an uppermost element and a bottommost element;

a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile; and a slider for moving between a closed position and an open position along the fastening strips in straddling relation, the slider having a top and side walls depending from opposite sides of the top for receiving the fastening strips therebetween, the side walls extending downward from the top to a point at or below the profiles, so that at least a portion of the profiles are held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles;

said first fastener strip and first profile being formed as an integral extruded first product wherein said first profile uppermost element and bottommost element are shaped as hooks with a first proximal portion and a first distal portion;

said second fastener strip and second profile being formed as an integral extruded second product wherein said second profile uppermost element and bottommost element are shaped as hooks with a second proximal portion and a second distal portion;

said first extruded product being formed by a first extrusion die with an extrusion opening defining an angle between the first proximal portion and first distal portion of the bottommost element at approximately 57°; and said second extruded product being formed by a second extrusion die with an extrusion opening defining an angle between the second proximal portion and second distal portion of the bottommost element at approximately 73°.

7. A reclosable fastener assembly comprising:

a first fastener strip having an inner surface and an outer surface;

a second fastener strip having an inner surface and an outer surface;

a first profile positioned along the length of the inner surface of the first fastener strip, the first profile having a plurality of closure elements, the plurality of closure elements including at least an uppermost element and a bottommost element;

a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile; and a slider for moving between a closed position and an open position along the fastening strips in straddling relation, the slider having a top and side walls depending from opposite sides of the top for receiving the fastening strips therebetween, the side walls extending downward from the top to a point at or below the profiles, so that at least a portion of the profiles are held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles;

said first fastener strip and first profile being formed as an integral extruded first product wherein said first profile uppermost element and bottommost element are shaped as hooks with a first proximal portion and a first distal portion;

said second fastener strip and second profile being formed as an integral extruded second product wherein said second profile uppermost element and bottommost element are shaped as hooks with a second proximal portion and a second distal portion;

said first extruded product being formed by a first extrusion die with an extrusion opening defining an angle between the first proximal portion and first distal portion of the uppermost element at approximately 78°, and said second extruded product being formed by a second extrusion die with an extrusion opening defining an angle between the second proximal portion and second distal portion of the uppermost element at approximately 73°.

8. A reclosable fastener assembly comprising:

a first fastener strip having an inner surface and an outer surface;

a second fastener strip having an inner surface and an outer surface;

a first profile positioned along the length of the inner surface of the first fastener strip, the first profile having a plurality of closure elements, the plurality of closure elements including at least an uppermost element and a bottommost element;

a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile; and a slider for moving between a closed position and an open position along the fastening strips in straddling relation, the slider having a top and side walls depending from opposite sides of the top for receiving the fastening strips therebetween, the side walls extending downward from the top to a point at or below the profiles, so that at least a portion of the profiles are held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles;

said first fastener strip and first profile being formed as an integral extruded first product wherein said first profile uppermost element and bottommost element are shaped as hooks with a first proximal portion and a first distal portion;

said second fastener strip and second profile being formed as an integral extruded second product wherein said second profile uppermost element and bottommost element are shaped as hooks with a second proximal portion and a second distal portion;

wherein said first profile includes a flange, said first extruded product being formed by a first extrusion die with an extrusion opening defining an angle between the first fastener strip and the flange of approximately 95°.

* * * * *